US008472826B2

(12) United States Patent
Hashiguchi

(10) Patent No.: US 8,472,826 B2
(45) Date of Patent: Jun. 25, 2013

(54) IMAGE FORMING APPARATUS

(75) Inventor: Shinji Hashiguchi, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 129 days.

(21) Appl. No.: 12/825,803

(22) Filed: Jun. 29, 2010

(65) Prior Publication Data

US 2010/0329719 A1 Dec. 30, 2010

(30) Foreign Application Priority Data

Jun. 30, 2009 (JP) ..... 2009-155663

(51) Int. Cl.
*G03G 15/20* (2006.01)

(52) U.S. Cl.
USPC ..... 399/68; 399/43; 399/329

(58) Field of Classification Search
USPC ..... 219/216, 244; 399/38, 43, 45, 67, 399/68, 75, 320, 328–331, 335
See application file for complete search history.

(56) References Cited

U.S. PATENT DOCUMENTS

| | | | | |
|---|---|---|---|---|
| 6,115,563 | A | 9/2000 | Miyamoto | |
| 6,785,484 | B2 * | 8/2004 | Nishiyama | 399/68 |
| 7,190,914 | B2 | 3/2007 | Nihonyanagi et al. | |
| 7,215,899 | B2 | 5/2007 | Kimizuka et al. | |
| 7,251,447 | B2 | 7/2007 | Kanamori et al. | |
| 7,280,775 | B2 | 10/2007 | Kubochi et al. | |
| 7,518,089 | B2 | 4/2009 | Hashiguchi et al. | |
| 2004/0190924 | A1 * | 9/2004 | Iwasaki et al. | 399/68 |
| 2009/0297236 | A1 | 12/2009 | Saito et al. | |
| 2010/0074661 | A1 | 3/2010 | Hashiguchi | |

FOREIGN PATENT DOCUMENTS

| | | |
|---|---|---|
| JP | 7-191571 | 7/1995 |
| JP | 11-143291 | 5/1999 |
| JP | 11-338302 | 12/1999 |
| JP | 11-344892 | 12/1999 |
| JP | 2000-267507 | 9/2000 |
| JP | 2002-169413 | 6/2002 |
| JP | 2002-351250 | 12/2002 |

* cited by examiner

*Primary Examiner* — Walter L Lindsay, Jr.
*Assistant Examiner* — Benjamin Schmitt
(74) *Attorney, Agent, or Firm* — Fitzpatrick, Cella, Harper & Scinto

(57) ABSTRACT

An apparatus includes a controller controlling feeding of a recording material. When the recording material size is smaller than a reference size, the controller expands an interval between precedent and subsequent recording materials gradually. When image formation on recording materials smaller than a reference size starts, when the elapsed time from the end of the last image formation exceeds a predetermined time, an initial value of the interval is set to a predetermined minimum value. When image formation on recording materials smaller than the reference size starts, when the elapsed time is shorter than the predetermined time, the initial value of the interval is set in accordance with the elapsed time and a last feeding interval at the time of an image formation of the last time or a last temperature in a non-sheet-passing region at the time of an image formation of the last time.

10 Claims, 5 Drawing Sheets

(a)

(b)

(a)

(b)

IMAGE FORMING APPARATUS

FIELD OF THE INVENTION AND RELATED ART

The present invention relates to an image forming apparatus such as an electrophotographic copying machine and an electrophotographic printer.

An image forming apparatus, such as a copying machine and a printer of an electrophotographic type, includes a fixing device of a heating-roller type and a film-heating type. As the fixing device of the film-heating type, an apparatus is known that includes a heater generating heat by electric power supply, a fixing sleeve comprising a flexible film moved while contacting the heater, and a back-up member that forms a nip with the heater through the fixing sleeve. While a recording material carrying an unfixed toner image is nipped and fed by the nip of the fixing device, it is heated, by which the toner image on the recording material is heat-fixed on the recording material. The fixing device has the advantage that the time required for the temperature rise to a fixing capable temperature after the start of the electric power supply to the heater is short. Therefore, a printer equipped with the fixing device can shorten the time until it outputs an image of the first sheet after the inputting of a print command (First Print Out Time). This type of fixing device also has the advantage that electric energy consumption is small during the waiting time un which the device waits for the print command. It is known that when a recording material of a small size is continuously printed at a recording-material feeding interval (feeding interval) the same as that for the recording material of a large size by a printer equipped with the fixing device which uses the fixing sleeve, the portion of the heater in which the recording material does not pass (the non-sheet-passing-range) rises excessively. When the non-sheet-passing-range of the heater rises excessively in temperature, a member such as the fixing sleeve or the back-up member deteriorates as a result of the increased heat, thereby increasing the likelihood of the occurrence of a defect of the recording-material feeding property and an image defect. In view of this, Japanese Laid-open Patent Application 2002-169413 proposes that the feeding interval (throughput) is expanded in accordance with the temperature of the non-sheet-passing-range of the heater in order to suppress the excessive temperature rise of the non-sheet-passing-range of the heater (the temperature rise of the non-sheet-passing-range), i.e., to suppress an excessive temperature rise. More specifically, a second temperature detecting member for detecting the heater temperature in the non-sheet-passing-region is provided, and the feeding interval is expanded before a detected temperature of the second temperature detecting member reaches the thermal-deterioration-occurrence temperature, during continuous printing. According to this method, by expanding the feeding interval during continuous printing, continuous printing can be carried out, while maintaining the temperature of the non-sheet-passing-range at less than the temperature causing heat deterioration. The heater-temperature rise in the non-sheet-passing-region continues in the fixing device not only during continuous printing but also in the case of the printing operations that continuously print a few pieces of a recording material repeatedly with short stops. For this reason, heat deterioration may occur in the fixing sleeve and the back-up member, and so on, of the fixing device. This is because 1) even if the feeding interval is expanded partially during continuous printing, with the repetition of the printing operation, the number of pieces of printing material printed with the wide feeding interval is small, and therefore, the heater temperature in the non-sheet-passing-region does not become sufficiently lower, 2) a next printing operation is started with a short stop, and therefore, before the heater temperature in the non-sheet-passing-region becomes sufficiently lower, and 3) when the subsequent printing operation is resumed with the short feeding interval, the temperature rise of the non-sheet-passing-range rapidly continues. As a measure against the case in which the next printing operation is resumed with a short stop, as has been described in 2), there is a method of starting the printing operation in the state that the feeding interval is expanded. More specifically, when a series of printing operations finishes, the last feeding interval in the printing operation is stored. In the case where the next printing operation is resumed within predetermined time set beforehand, the printing operation is started at the feeding interval the same as the last feeding interval in the previous print operation. In other words, in the case where current print start timing is within predetermined time from the end of the previous print operation, an initial value of the feeding interval in the current print operation is set to the last feeding interval in the previous print operation, and in the case where the current print start timing is after the elapse of the predetermined time, the initial value of the feeding interval in the current print operation is set to a predetermined minimum value. According to this method, also under the above-described print condition, the printing operation is started with the feeding interval expanded assuredly, and therefore, printing can be carried out in the state that the heater temperature in the non-sheet-passing-region is maintained below the thermal-deterioration-occurrence temperature. However, it has been noted that this technique still has room for improvement in terms of print productivity.

SUMMARY OF THE INVENTION

An object of the present invention is to provide an image forming apparatus in which the reduction of the number of small-size sheet prints per unit time is suppressed.

According to an aspect of the present invention, there is provided an image forming apparatus comprising an image forming station for forming a toner image on a recording material; an image fixing station for heat-fixing the toner image formed on the recording material on the recording material; a feeding controller for controlling feeding of the recording material, wherein when the size of the recording material is smaller than a reference size, the feeding controller expands the feeding interval between a precedent recording material and a subsequent recording material gradually, and wherein when image formation on a plurality of recording materials which are smaller than the reference size is started, at timing at which an elapsed time from an end of a last image formation exceeds a predetermined time, the feeding control means sets an initial value of the feeding interval to a predetermined minimum value, and wherein when image formation on a plurality of recording materials smaller than the reference size is started, at the timing at which the elapsed time is shorter than the predetermined time, the feeding control means sets the initial value of the feeding interval in accordance with the elapsed time and a last feeding interval at the time of an image formation of the last time.

According to another aspect of the present invention, there is provided an image forming apparatus comprising an image forming station for forming a toner image on a recording material; an image fixing station for heat-fixing the toner image formed on the recording material on the recording material; a feeding controller for controlling feeding of the recording material, wherein when the size of the recording material is smaller than a reference size, the feeding controller expands the feeding interval between a precedent recording material and a subsequent recording material gradually, and wherein when image formation on a plurality of recording materials which are smaller than the reference size is started, at timing at which an elapsed time from an end of a last image formation exceeds predetermined time, the feeding control means sets an initial value of the feeding interval to a predetermined minimum value, and wherein when image formation on a plurality of recording materials smaller than the reference size is started, at the timing at which the elapsed time is shorter than the predetermined time, the feeding control means sets the initial value of the feeding interval in accordance with the elapsed time and a last temperature in a non-sheet-passing region of said fixing station at the time of an image formation of the last time.

These and other objects, features, and advantages of the present invention will become more apparent upon consideration of the following description of the preferred embodiments of the present invention, taken in conjunction with the accompanying drawings.

Figure 2:
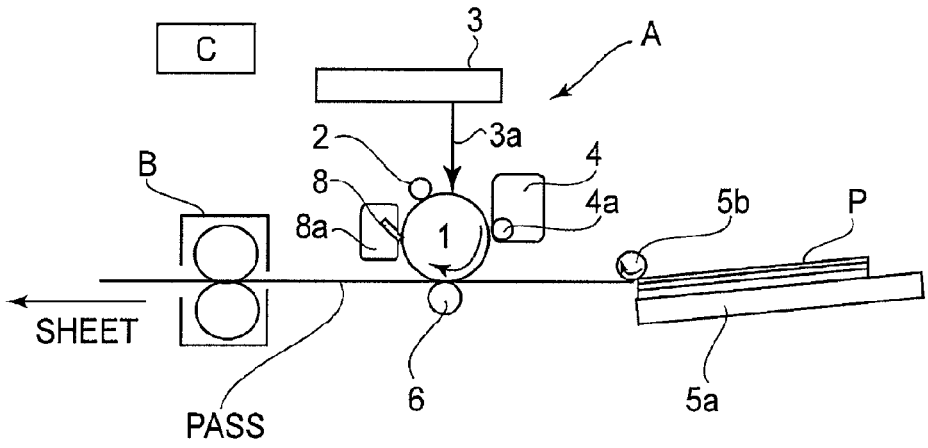
Figure 2:
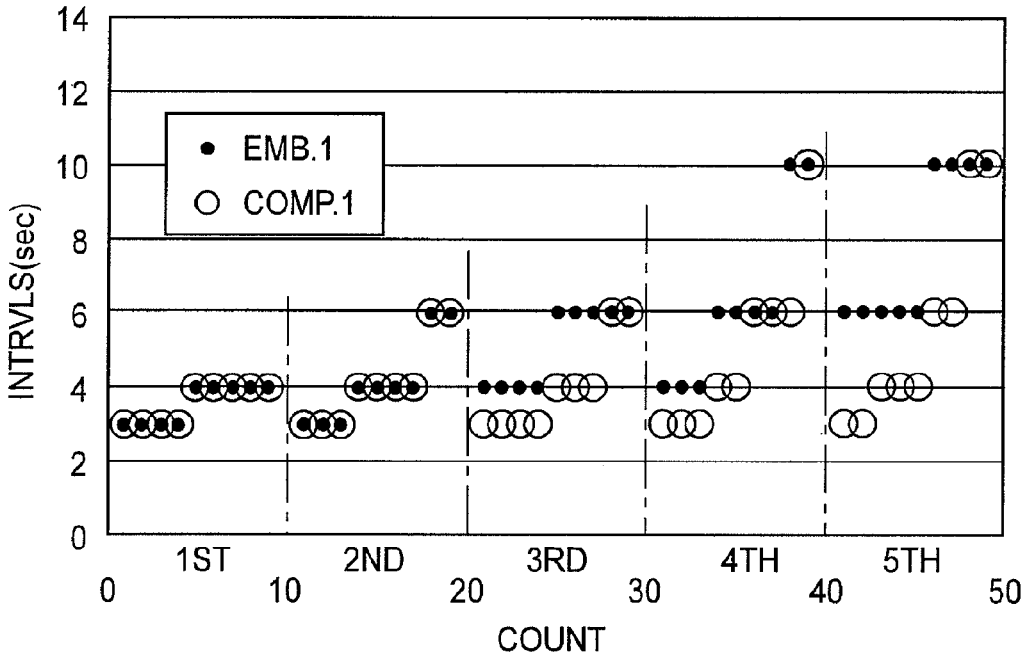

Part (a) of FIG. 2 shows a general arrangement of an example of the image forming apparatus according to the first embodiment. Part (b) of FIG. 2 is an illustration of changes of a feeding interval when the downtimes between the sets in the image forming apparatus of Embodiment 1 and an image forming apparatus of a comparison Example 1 are 15 seconds.

Figure 3:
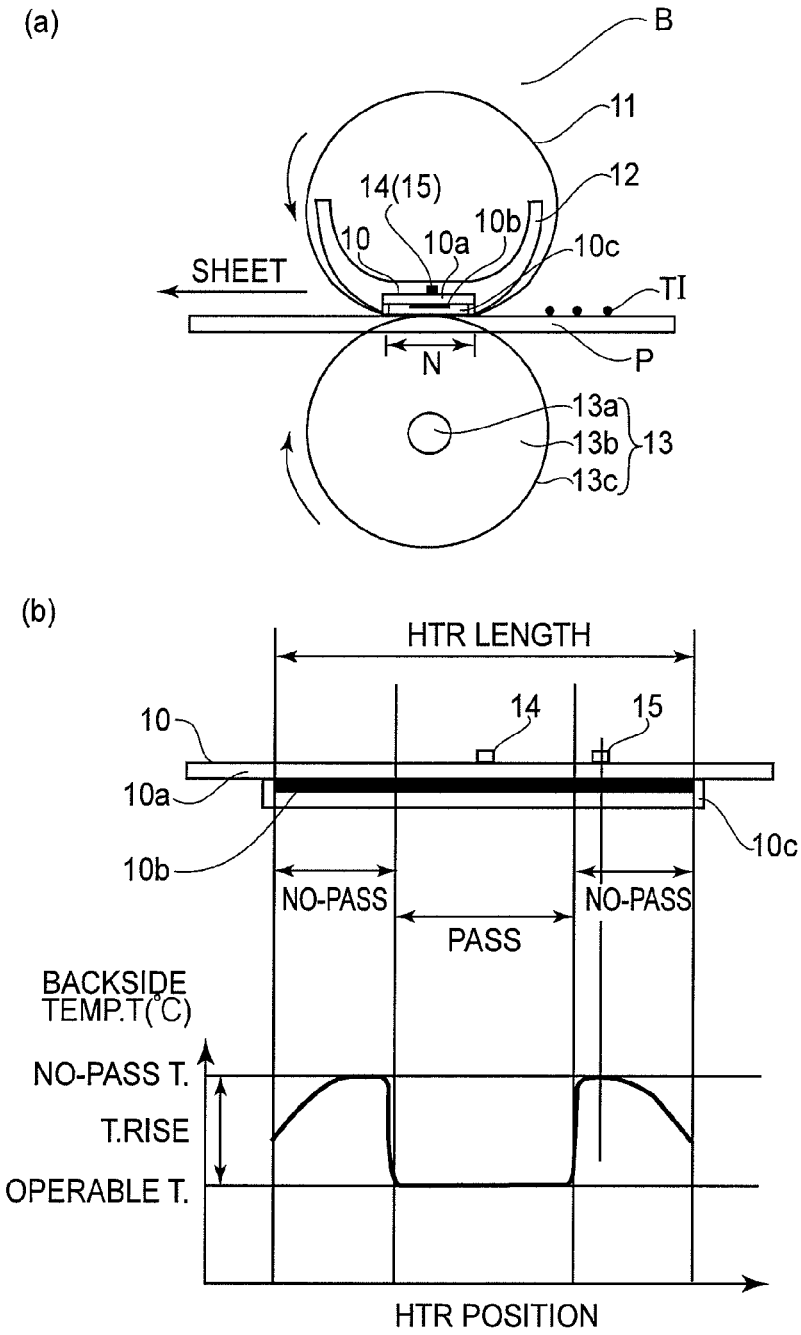

Part (a) of FIG. 3 is a cross-sectional view of a fixing device. In the part (b), the upper portion shows a position of a first temperature detecting member and a second temperature detecting member for detecting temperatures of a heater, and the lower portion shows a temperature rise of the non-sheet-passing-range of the heater.

Figure 4:
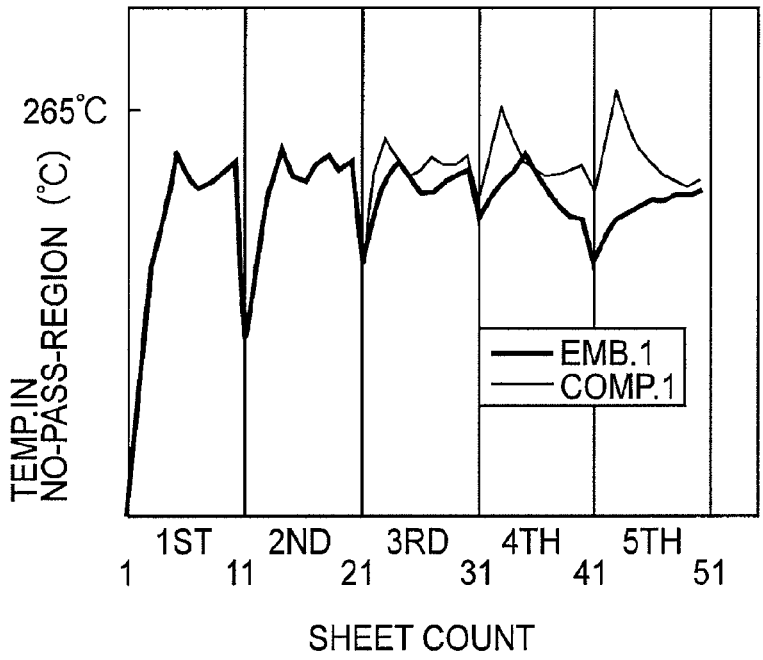
Figure 4:
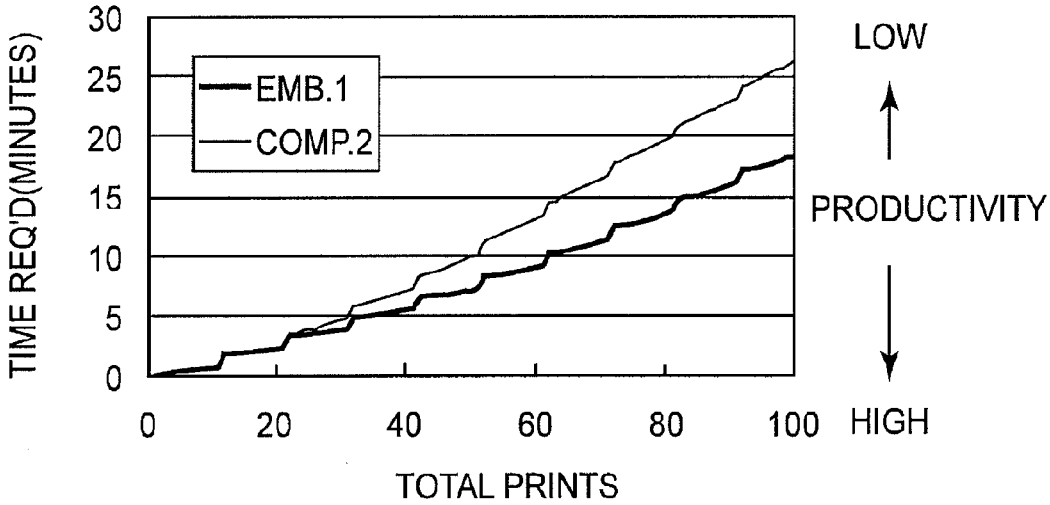

Part (a) of FIG. 4 shows a temperature change of the second temperature detecting member in the image forming apparatus of Embodiment 1, and the image forming apparatus of the comparison example 1. Part (b) is a graph of the printing period in the case that the rest interval between the printing operations is 45 seconds in the image forming apparatus of Embodiment 1, and the image forming apparatus of the comparison example 2.

Figure 5:
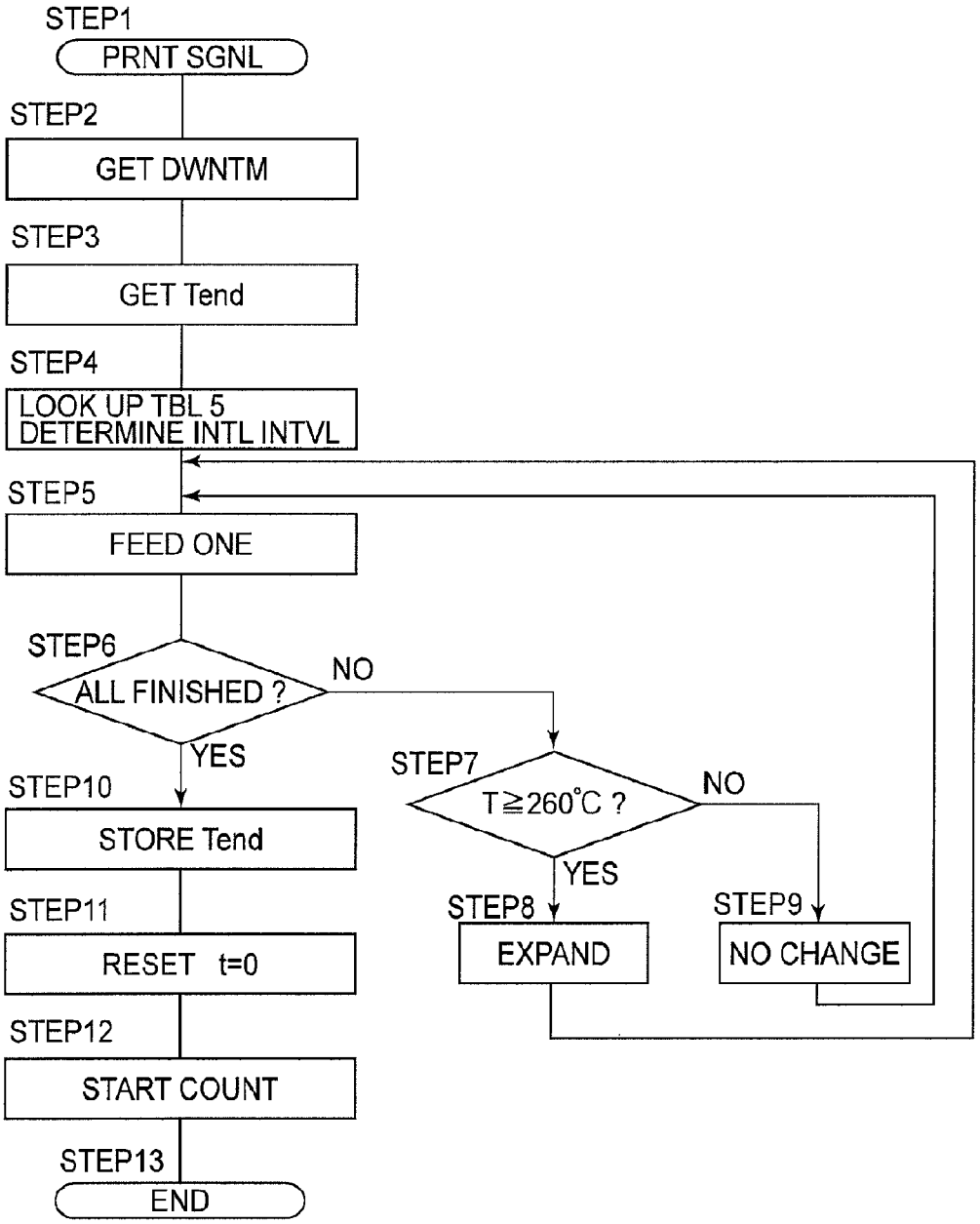

FIG. 5 is a flowchart of a feeding-interval control sequence in an image forming apparatus relating to a second embodiment.

DESCRIPTION OF THE PREFERRED EMBODIMENTS

First Embodiment

(1) Image Forming Apparatus

Part (a) of FIG. 2 shows a general arrangement of an example of the image forming apparatus according to the first embodiment. This image forming apparatus is a laser printer using an electrophotographic process, and is equipped with the fixing device of a film heating type. The image forming apparatus of the first embodiment comprises an image forming station A, a fixing station B, and a controller C (including a feeding controller). The controller C comprises a CPU and a memory such as a RAM and a ROM, and the memory stores various control-sequence operation programs required for image formation. In the image forming apparatus according to this Embodiment 1, the controller C executes a predetermined image-formation control sequence in accordance with a printing signal outputted from an external device (unshown) such as a host computer. The image forming station A and the fixing station B carry out a predetermined image-forming operation in accordance with the image-formation control sequence. More particularly, in the image-forming operation (printing operation), the image forming station A transfers the image onto the recording material, and a nip of the fixing device of the fixing station B nips and feeds the recording material to fix the image on the recording material. In the image forming station A, an image-formation motor (unshown) is rotationally driven to rotate a photosensitive drum 1 as an image-bearing member at a predetermined peripheral speed (process speed) in the direction indicated by an arrow. The photosensitive drum 1 comprises a cylindrical base member composed of a material such as aluminum or nickel and a photosensitive material of such as OPC, amorphous Se, or amorphous Si thereon. The outer surface of the photosensitive drum 1 thereof is uniformly charged to a predetermined potential of the predetermined polarity by a charging roller 2 as a charging member. A laser scanner 3 as exposure means outputs a laser beam 3*a*, which is on/off modulated corresponding to a time-series, electrical, digital pixel signal of image information outputted from the above-described external device to expose and scan the charged surface of a surface of the photosensitive drum 1 to rotate. By this scanning and exposure operation, an electrostatic latent image (electrostatic image) corresponding to the image information is formed on the photosensitive drum 1 surface. A developing device 4 develops the electrostatic latent image on the photosensitive drum 1 surface into a toner image by a developing roller 4*a* as a developer carrying member using toner as a developer. As for the developing method, a jumping-development method, for example can be used. On the other hand, a feeding roller 5*b* rotates in the direction of the arrow to pick up and feed the recording material P one by one from a feeding cassette 5*a* which stacks the recording material P. This feeding cassette 5*a* is provided with a movable regulation guide (unshown) therein for stacking different size recording materials. The regulation guide is moved in accordance with the size of the recording material P, and the different size recording materials can be fed from the feeding cassette 5*a*. The recording material P fed by the feeding roller 5*b* is fed into a transfer nip portion between the outer surfaces of the photosensitive drum 1 surface and a transfer roller 6 as a transfer member through a sheet passage. The recording material P thereof is nipped and fed by the photosensitive drum 1 surface and the transfer roller 6 surface in the transfer nip portion. In a feeding process thereof, the transfer bias voltage is applied from the transfer-bias voltage source (unshown) onto the transfer roller 6, by which the toner image on the photosensitive drum 1 surface is transferred onto the recording material P. By this, an unfixed toner image is carried on the recording material P. The recording material P which passed the transfer nip portion is introduced into the nip (fixing nip) of a fixing device B. The application of the heat and pressure in the nip heat-fixes the toner image on the recording material P. The recording material P thereof is discharged from the fixing device B to be placed on a discharging tray (unshown) been provided in an outside of the image forming apparatus. Untransferred toner which remains on the photosensitive drum 1 surface is removed by cleaning means 8 from the photosensitive drum 1 surface which finishes the transferring of the toner image to be prepared for the next image formation. The untransferred toner removed from the photosensitive drum 1 surface by the cleaning means 8 is collected into the toner storage 8*a*.

(2) Fixing Device

In the following descriptions, with respect to the fixing device and the members which constitute the fixing device, a longitudinal direction is the direction perpendicular to a sheet-feeding direction on the surface of the recording material. A widthwise direction is the direction in parallel to the sheet-feeding direction in the surface of the recording material. A length is a dimension measured in the longitudinal direction. A width is a dimension measured in the widthwise direction. With respect to the recording material, the widthwise direction is the direction perpendicular to the sheet-feeding direction on the surface of the recording material. The longitudinal direction is the direction parallel with the sheet feeding direction on the surface of the recording material. The width is a dimension measured in the widthwise direction. The length is a dimension measured in the longitudinal direction. Part (a) of FIG. 3 is a cross-sectional view of the fixing device. The fixing device B according to this Embodiment 1 is a film-heating-type fixing device. In the fixing device B, designated by reference numeral 10 is a heater as a heat generating member. The heater 10 includes an elongated heater substrate 10*a*. The heater substrate 10*a* is provided with an electric-power-supply, heat-generating resistor 10*b* as a heating element extending in the longitudinal direction of the heater substrate 10*a*. The electric-power-supply, heat-generating resistor 10*b* is coated with a protecting glass layer 10*c*. The heater substrate 10*a* is a thin plate heater substrate made of $Al_2O_3$ that is thermally conductive. The material of which the heater substrate 10*a* is composed may be AlN. The electric-power-supply, heat-generating resistor 10*b* is made by forming the pattern of an electric-power-supply, heat-generating resistor paste comprising, as main component, Ag/Pd by a screen printing on the surface of the heater substrate 10*a*, and calcinating it. Theelectric-power-supply, heat-generating resistor 10*b* is provided with an electric-power-supply electrode pattern (unshown) inside of longitudinal opposite end portions of the heater substrate 10*a*, which is formed integrally with the heater substrate 10*a*. The heat-generating resistor 10*b* is supplied with electric power from an electric-power-supply control circuit (unshown) through the electric-power-supply electrode pattern to generate heat. The protecting glass layer 10*c* coats the heat-generating resistor 10*b* (coating glass layer), in order to assure electrical insulation of the heat-generating resistor 10*b*, and in order to assure a wearing property relative to the fixing sleeve 11 as will be described hereinafter. Designated by reference numeral 11 is a fixing sleeve as a fixing member. The fixing sleeve 11 comprises a SUS sleeve which has a small heat capacity, a heat resistance, thermo plasticity, and a thickness of 35 micrometers (base layer) and a thin elastic rubber film of heat-resistive silicone rubber foam which has a thickness of 300 micrometers thereon. As the material of the base layer of the fixing sleeve 11, there are plastic resin film of polyimide, polyamidoimide, PEEK, PES, PPS, PFA, PTFE, FEP or the like, or a monolayer thin film metal sleeve of SUS or the like As the thin elastic rubber film, fluorine-containing rubber or the like can also be used. The outer surface of the thin elastic rubber film may be coated with a heat-resistant parting property layer such as fluorinated resin material of PFA, PTFE, FEP or the like. Designated by reference numeral 12 is a heater-supporting member as a supporting member. The heater-supporting member 12 is a trough-type member and has a substantially semicircular section. A lower surface of the heater supporting member 12 is provided with a groove extended in the longitudinal direction in a central portion with respect to a widthwise direction of the heater-supporting member 12. The groove supports the heater 10, so that the protecting glass layer 10*c* faces down. Around an outer periphery of the heater-supporting member 12 supporting the heater 10, the fixing sleeve 11 is telescoped loosely. Therefore, the heater-supporting member 12 supports the heater 10, and supports the fixing sleeve 11 to provide also the function of a guiding member for prompting smooth rotation. The heater-supporting member 12 is molded from PPS. The material of the heater-supporting member 12 preferably has a high insulating property in order to prevent heat radiation in a direction opposite from the nip N as will be described hereinafter, and it is a liquid crystal polymer, phenol resin, PEEK, and so on, for example. Designated by reference numeral 13 is a pressing roller as a back-up member. The pressing roller 13 comprises a round, shank-like metal core 13*a* and an elastic rubber layer 13*b* of silicone rubber foam of a thickness of 3 mm thereon. As the material of the elastic rubber layer 13*b*, heat-resistant rubber, such as the fluorine-containing rubber, may be used. The outer surface of the elastic rubber layer may be coated with a heat-resistant, parting-property layer 13*c* composed of fluorinated resin material or the like, such as PFA, PTFE, FEP. The pressing roller 13 is provided in parallel with the fixing sleeve 11 in the lower portion of the fixing sleeve 11, and the longitudinal opposite end portions of the metal core 13*a* are rotatably supported by a frame (unshown) of the fixing device B through bearings (unshown). The bearings for the longitudinal end portions of the metal core 13*a* are urged at a predetermined pressure toward the fixing sleeve 11 by pressing springs (unshown), so that the nip N of the predetermined width which interposes the fixing sleeve 11 is provided between the pressing roller 13 and the heater 10. The recording material P carrying the unfixed toner image is introduced into the nip N in the state that a longitudinal center position of the heat-generating resistor 10*b* of the heater 10 and a widthwise center of the recording material P are aligned with each other.

In part (b) of FIG. 3, the upper portion shows the positions of the first temperature detecting member and the second temperature detecting member for detecting the temperatures of the heater, and the lower portion shows the heater temperature rise in the non-sheet-passing-region. Designated by reference numeral 14 is the first temperature-detecting member and reference numeral 15 is the second temperature-detecting member. The first temperature-detecting member 14 and the second temperature-detecting member 15 are provided with the temperature detecting elements, such as semiconductors whose resistance values change depending on the temperature, for example, respectively, and the temperature is detected by monitoring the change of the resistance value by the unshown electrical circuit. The first temperature-detecting member 14 is disposed in a range (sheet-feeding range), which is adjacent to the heater 10, and which is within the recording-material passing width, when the recording material of a minimum width usable with the image forming apparatus passes through the nip N. The reason for disposing the first temperature-detecting member 14 in the sheet-feeding range is as follows. This is done in order to control the temperature of the sheet-feeding range of the heater 10, such that the temperature is the temperature providing a satisfactory fixability even when not only a recording material of the minimum width, but also a recording material of a maximum width usable with the image forming apparatus are passed through the nip N. The second temperature-detecting member 15 is disposed in a range (non-sheet-passing-range), which is adjacent to the heater 10, and which is an outside of the recording-material passing width, when the recording material of the minimum width passes through the nip N. The reason for disposing the second temperature-detecting member 15 in the non-sheet-passing-range is as follows. This is done in order to carry out control for expanding the feeding intervals (feeding intervals) of the recording material into the nip, in response to changes in the temperature, in the non-sheet-passing-range, of the heater 10, during the image forming operation of continuous printing on recording materials of two or more sheets.

In the fixing device B according to this Embodiment 1, the controller C executes a predetermined rotational-driving-control sequence in accordance with the printing signal to rotate the pressing roller 13 and the fixing sleeve 11. More particularly the controller C drives a fixing motor (unshown) in accordance with the printing signal to rotate the driving gears (unshown) provided at the longitudinal end portions of the metal core 13*a* of the pressing roller 13 in the predetermined direction. By this, the pressing roller 13 is rotated at a predetermined peripheral speed (process speed) in the direction of the arrow. The rotational force of this pressing roller 13 is transmitted to the fixing sleeve 11 by the frictional force between a pressing roller 13 surface and a fixing sleeve 11 surface in the nip N. By this, the fixing sleeve 11 is rotated by the rotation of the pressing roller 13 around the heater-supporting member 12, while an inner surface thereof slides on the protecting glass layer 10*c* of the heater 10. The controller C executes a predetermined temperature-control sequence in accordance with the printing signal to control the temperature of the heater 10. More particularly the controller C renders ON the electric power-supply control circuit in accordance with the printing signal to supply electric power from the electric power-supply control circuit to the heat-generating resistor 10*b* through the electric-power-supply electrode pattern of the heater 10. By this, the heat-generating resistor 10*b* generates heat to heat the rotating fixing sleeve 11 through the protecting glass layer 10*c*. At this time, the first temperature-detecting member 14 detects the temperature of the sheet-feeding range of the heater to output it to the controller C. The controller C receives an output signal from the first temperature-detecting member 14, and on the basis of this output signal, it controls the electric power-supply control circuit, so that the temperature of the heater 10 maintains a predetermined fixing temperature (target temperature). More particularly the fixing temperature is maintained at 200-220 degrees C. In the state that the heater 10 and rotating pressing roller 13 and the fixing sleeve 11 are maintained at the predetermined fixing temperature, the recording material P carrying the unfixed toner image TI is fed into the nip N with a toner image carrying surface at an upper side thereof. The recording material P thereof is nipped and fed by the fixing sleeve 11 surface and the pressing roller 13 surface in the nip N. In the feeding process thereof, the toner image TI is heat-fixed on the recording material P by the heat of the fixing sleeve 11 and the pressure of the nip N. The recording material P is discharged from the nip N, while the toner image carrying surface separates from the fixing sleeve 11 surface.

(3) Feeding Interval Control

In the fixing device B, when the recording material, the width of which is narrower than the recording material of the maximum width, is fed to the nip N, for example, the temperature of the non-sheet-passing-range is high, as shown in the lower portion of part (b) of FIG. 3. In other words, a temperature rise of the non-sheet-passing-range occurs. In view of this, the controller C carries out control for expanding the feeding interval during the continuous printing of narrow recording materials, in response to a detected temperature detected by second temperature sensor 15 shown in the upper portion of part (b) of FIG. 3. In other words, by the feeding controller of this example, the feeding interval between the precedent recording material and the subsequent recording material is expanded gradually, when the images are formed on recording materials smaller than a reference size (maximum width recording material size in this example). In the image forming apparatus of the first embodiment, an initial feeding interval in the current print operation is determined on the basis of the last feeding interval in a previous print operation, and, an elapsed time from the end of the last printing operation to the start of this time printing operation. In other words, in the case where the image formation is started on recording materials smaller than the reference size, at a timing at which the elapsed time from the time of the end of the last image formation exceeds the predetermined time, the feeding control means sets an initial value of the feeding interval to a predetermined minimum value, and when the image formation is started on recording materials smaller than the reference size, at a timing at which the elapsed time is less than the predetermined time, the feeding control means sets the initial value of the feeding interval in accordance with the elapsed time and the last feeding interval at the time of the previous image formation. This is the process of step 4 in a flowchart of the feeding interval control sequence of FIG. 1.

Figure 1:
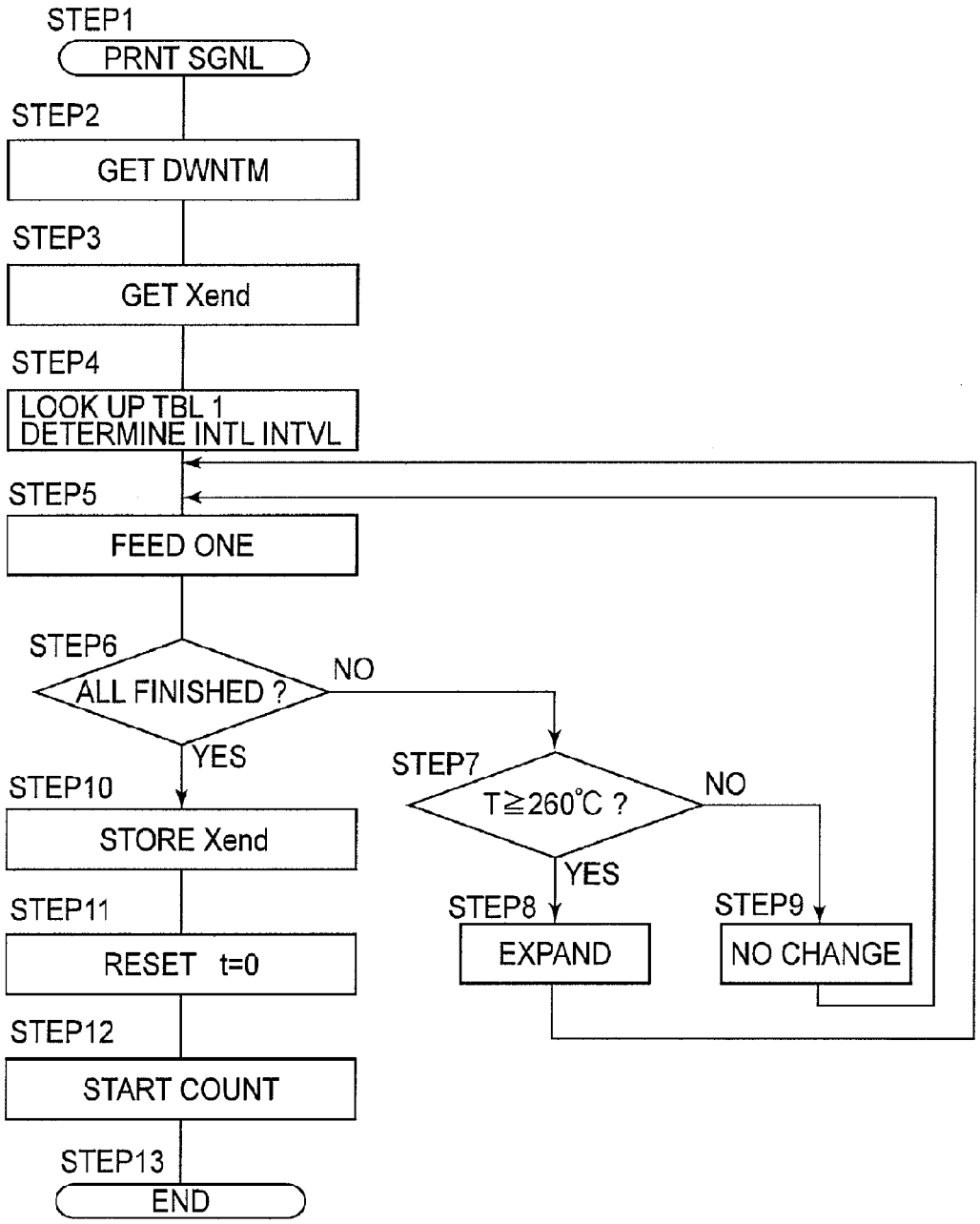
FIG. 1 is a flowchart of a feeding interval control sequence of an image forming apparatus according to a first embodiment.

FIG. 1 is a flowchart of the feeding interval control sequence.

Step 1: The printing signal for starting the current print operation is received.

Step 2: The elapsed time t (sec) from the previous print operation is obtained. In other words, the elapsed time t (sec) from the end of the previous print operation to the start of the current print operation is determined. The count of the elapsed time t is started at the time of the end of a series of printing operations by setting a time counter, and step 12 corresponds to this. The counting of this elapsed time t is finished at the time of receiving the printing signal for starting the current print operation, and step 1 corresponds to this. In the image forming apparatus according to this Embodiment 1, immediately after ON of a voltage source of the image forming apparatus, t=61 (sec) is set as a default. This means that that the printing is started with the shortest feeding interval in the printing operation immediately after ON of the voltage source. Therefore, the count by the time counter continues for the 60 seconds (predetermined time period). When it exceeds 60 seconds (predetermined time), (after t=61 (sec)), the print is started at the shortest feeding interval (feeding interval). The level of the feeding interval which can be selected in the image forming apparatus according to this Embodiment 1 is determined in step 4. The time t is set to 61 seconds for the reason that, immediately after the voltage source ON, an initial operation for the 80 seconds is carried out in order to provide a satisfactory image. In the initial operation, an initial check is carried out in order to confirm the normal operation of the image forming apparatus, and a remaining-paper detection in the image forming apparatus is carried out. During the period of the initial operation, a non-feeding portion temperature of the heater 10 is lowered, and therefore, even in the case that immediately after the temperature rise of the non-sheet-passing-range continues, the voltage source is rendered OFF and then ON, and the printing is carried out immediately, for example, the printing operation is capable of being performed without the heat deterioration of the fixing sleeve and the pressing roller.

Step 3: A last feeding interval Xend (sec) in the previous print operation is obtained. The last feeding interval Xend in the previous print operation is stored, when the series of printing operations are finished, and step 10 corresponds to this.

Step 4: The control looks the table 1 up, and determines the initial stage feeding interval in the current print operation on the basis of the last feeding interval in the previous print operation Xend, and the elapsed time from the previous print operation.

TABLE 1

| Determination for initial sheet interval | | | | | |
|---|---|---|---|---|---|
| Last Intrvl | Elapsed time from Last printing (sec) | | | | |
| Xend (sec) | t ≦ 10 | 10 < t ≦ 20 | 20 < t ≦ 40 | 40 < t ≦ 60 | 60 < t |
| 15 | 15 | 10 | 6 | 4 | 3 |
| 10 | 10 | 6 | 4 | 3 | 3 |
| 6 | 6 | 4 | 3 | 3 | 3 |
| 4 | 4 | 3 | 3 | 3 | 3 |
| 3 | 3 | 3 | 3 | 3 | 3 |

In the feeding interval control sequence according to this Embodiment 1, the feeding intervals which can be selected are 3 seconds, 4 seconds, 6 seconds, 10 seconds and 15 seconds (five levels). As shown in the table 1, the initial feeding interval in the printing operation is set in accordance with the degree of the continuation of the temperature rise of the non-sheet-passing-range. More specifically, the wider the last feeding interval in the previous print operation is, the more the temperature rise of the non-sheet-passing-range advances, and therefore, the current print operation is started with the wide feeding interval in order to prevent heat deterioration. The same applies, even in the case where the elapsed time t from the previous print operation is short, 10 seconds or less, for example. On the other hand, the shorter the last feeding interval in the previous print operation, or the longer the elapsed time from the previous print operation, the less the temperature rise of the non-sheet-passing-range advances, and therefore, the current print operation is started with the short feeding interval in order to enhance the print productivity. In the case where the current print operation is started with the determined feeding interval, the controller C controls the image forming station A and the fixing device B, so that the printing operation of the recording material P is carried out in accordance with the feeding interval.

Step 5: The print is carried out on the recording material of one sheet with the initial feeding interval determined by step 4.

Step 6: When all the printing operations required for printing the recording material of two or more sheets finishes, (YES), the operation advances to step 10. When they do not finish (NO), the operation advances to step 7.

Step 7: A discrimination is made as to whether or not the feeding interval is expanded during the continuous printing of a plurality of recording materials. This determination is based on whether or not the detected temperature of the second temperature-detecting member 15 is not less than the fixing temperature (target temperature), 260 degrees C., for example. In the present Embodiment 1, if the detected temperature of the second temperature-detecting member 15 is maintained at 265 degree C., it can be confirmed beforehand that heat deterioration does not occur in the fixing and pressing members, such as the fixing sleeve 11 and the pressing roller 13, and therefore, 260 degrees C. is selected as a criterion of determination in consideration of a margin of 5 degrees C. The heat deterioration is mainly caused by the heat in the fixing sleeve 11 and the pressing roller 13. When the elastic rubber layer of the fixing sleeve 11 and the elastic rubber layer 13*b* of the pressing roller 13 are softened or deteriorated by the heat, deterioration of the recording material feeding property and the production of a poor image may be caused. In a high temperature state, surface layer wearing of the fixing sleeve 11 and the pressing roller 13 is promoted, and the toner and paper dust is deposited on the fixing sleeve 11 surface and the pressing roller 13 surface, so that image contamination may occur. When the temperature T of the non-sheet-passing-range is 260 degrees C. or higher, (YES), the operation advances to step 8, and when it is below 260 degrees C. (NO), the operation advances to step 9.

Step 8: The feeding interval is expanded by the one level, and the operation returns to step 5. In other words, when the temperature T of the non-sheet-passing-range is 260 degrees C. or higher, the feeding interval is expanded by one level at step 8.

Step 9: The feeding interval is not changed, and the operation returns to step 5.

Step 10: The final feeding interval in the foregoing printing operation is stored as the Xend.

Step 11: The time counter is reset (t=0).

Step 12: The time counter is set, and the count of the elapsed time t is started.

Step 13: This series of printing operation is finished.

An effect of the process of step 4 will be described.

1) The comparison in the heat deterioration of the fixing and pressing members between the image forming apparatus of Embodiment 1 and the image forming apparatus of a comparison example 1:

The production of heat deterioration in the fixing device is compared after the image forming apparatus of Embodiment 1 and the image forming apparatus of the comparison example 1 are operated under the same print conditions. Here, the image forming apparatus of Embodiment 1 uses the feeding interval control flowchart described with FIG. 1. The image forming apparatus of Embodiment 1 determines the initial feeding interval in the current print operation on the basis of the last feeding interval Xend in the previous print operation and the elapsed time t from the previous print operation. The image forming apparatus of the comparison example 1 fixes the initial feeding interval in the printing operation at the 3 seconds irrespective of the previous print operation. The image forming apparatus of Embodiment 1 and the image forming apparatus of the comparison example 1 have the same structures except that they have different feeding intervals. More specifically, in the image forming apparatus of Embodiment 1 and the image forming apparatus of the comparison example 1, the maximum width of the usable recording material P is 298 mm (width of the sheet A3). A longitudinal size of the heat generating resistor 10*b* of the heater 10 is 305 mm, and the recording material P is fed with alignment between the longitudinal center position of the heat generating resistor 10*b* and the widthwise center of the recording material. The second temperature-detecting member 15 is disposed at 135 mm position from a longitudinal center of the heat generating resistor 10*b*. The common print condition is relatively severe, namely the recording material P has a width of 100 mm, a length of 276 mm, and basis weight of 199 g/cm$^2$. The 10 recording materials P are subjected to the printing operation continuously, as one set, and the printing of the set five timess is repeated. The downtimes between the sets are 15 seconds, 30 seconds, 45 seconds. The ambient temperature is 25 degrees C., and the printing operation is started after the fixing device sufficiently reaches the ambient temperature. Part (b) of FIG. 2 shows the change of the feeding interval when the downtime between the sets is the 15 seconds in the image forming apparatus of Embodiment 1 and the image forming apparatus of the comparison example 1. In the image forming apparatus of Embodiment 1, the downtime between the sets is the 15 seconds, and therefore, Table 1 is looked up, the initial value of the feeding interval in and after the 2nd set is the feeding interval shorter by one level than a last feeding interval in the previous set. As shown in part (b) of FIG. 2, in and after the 3rd set, the initial value of the feeding interval increases gradually, and the 5th set is started with the 6 seconds of the feeding interval, so that the temperature rise of the non-sheet-passing-range is discouraged. On the other hand, in the comparison example the feeding interval is started with 3 sec which is the shortest irrespective of the feeding interval of the pre-setting. For this reason, also in and after the 3rd set in which the temperature rise of the non-sheet-passing-range of the fixing device occurs, the feeding interval is started with 3 sec. In the image forming apparatus of Embodiment 1 and the image forming apparatus of the comparison example 1, the temperature change of the second temperature-detecting member at the time of printing under the above-described print conditions is shown in part (a) of FIG. 4. In the image forming apparatus of Embodiment 1, as shown in part (b) of FIG. 2, the feeding interval at the time of the print start between the adjacent sets starts with the feeding interval shorter by one level than, the last feeding interval in the previous set. In part (b) of FIG. 2, the initial feeding interval in the previous print operation is X1, the last feeding interval in the previous print operation is X3, and the initial feeding interval in the current print operation is X2. In Embodiment 1, in the sets after the 2nd set, the relation among feeding intervals X1, X2, X3 satisfies x1<X2<X3. For this reason, as shown in FIG. 20B, even in the case where the detected temperature of the second temperature-detecting member is high at the time of the print start, the temperature rise of the non-sheet-passing-range is suppressed. By doing so, it has been confirmed that the detected temperature of the second temperature-detecting member during printing does not exceed 265 degrees C. at which it is confirmed that heat deterioration does not occur in the fixing and pressing members. On the other hand, in the image forming apparatus of the comparison example, even in the state of carrying out the temperature rise of the non-sheet-passing-range, the feeding interval is started with the shortest interval of 3 seconds, and therefore, in and after the 3rd set, the detected temperature of the second temperature-detecting member rapidly rises immediately after the first several sheets. For this reason, as shown in part (a) of FIG. 4, in the 4th set and the 5th set, the temperature of 270 degrees C. at which heat deterioration may occur in the fixing and pressing members is exceeded in the non-feeding portion. After the printing on 500 sheets under the above-described print condition, the results of the heat deterioration of the heating and fixing members are as shown in Table 2.

TABLE 2

| Downtime(interval) between sets (sec) | Embodiment 1 | Comparison Ex. 1 |
|---|---|---|
| 15 | G | N |
| 30 | G | F |
| 45 | G | G |

G: no thermal deterioration:
F: slight thermal deterioration:
N: thermal deterioration occurs:

As will be understood from Table 2, in the image forming apparatus of the comparison example 1, in the case where the downtime between the sets is short, the softening and deterioration by heat are observed in the fixing sleeve of the non-sheet-passing-range and the elastic layer of the pressing roller. On the other hand, in the image forming apparatus of Embodiment 1, heat deterioration does not occur irrespective of the downtime for the setting. As will be understood from the foregoing, the image forming apparatus of Embodiment 1 can print on the recording materials without causing deteriorating, by heat, of the fixing and pressing members of the fixing device even in the case where the printing operation of continuously printing on a few recording materials is repeated by the short stop.

2) Comparison of Print Productivity (Productivity of Image Formation)

The used image forming apparatus is similar to the one described above. In the image forming apparatus of the comparison example 2, in the case where it starts the subsequent (current) printing operation within less than 50 seconds after the previous print operation finishes, the initial feeding interval in the current print operation is set to the interval the same as the last feeding interval in the previous print operation. Similarly to the case described above, the recording material has width of 100 mm, a length of 276 mm, and a basis weight of 199 g/cm$^2$. As the print condition, the 10 recording materials P are subjected to the printing operation continuously, as one set, and the sets are repeatedly printed 10 times with a predetermined downtime. The rest intervals between the printing operations are 15 seconds, 30 seconds, and 45 seconds, and the printing is started in the state that the fixing device is sufficiently cooled to the ambient temperature. The ambient temperature is 25 degrees C. In the image forming apparatus of Embodiment 1 and the image forming apparatus of the comparison example 2, part (b) of FIG. 4 is a graph of the printing period in the case that the rest interval between the printing operations is 45 seconds under the above-described print conditions. In the image forming apparatus of the comparison example 2, the feeding interval at the time of a next set start is the last feeding interval of the previous set in spite of the temperature of the non-sheet-passing-range of the heater being sufficiently low as compared with the state immediately after the previous set end, and therefore, the print productivity is very low. On the other hand, in the image forming apparatus of Embodiment 1, a print interval at the time of the next set start is properly set in response to the elapsed time from the previous set end, and therefore, the print productivity does not significantly decreaser. The table 3 shows the durations until the printing of the 100 sheets is finished in the image forming apparatus of Embodiment 1 and the image forming apparatus of the comparison example 2. In the case where the downtime between the printing operations is any of 15 seconds, 30 seconds, and 45 seconds, the image forming apparatus of Embodiment 1 can shorten the printing period significantly, as compared with the image forming apparatus of the comparison example 2. In the image forming apparatuses of Embodiment 1 and the comparison example 2, the heat deterioration of the fixing and pressing members does not occur.

TABLE 3

| Required time for 100 prints | | |
|---|---|---|
| Downtime(interval) between sets (sec) | Embodiment 1 | Comparison Ex. 2 |
| 15 | 18 min. 9 sec. | 22 min. 53 sec. |
| 30 | 18 min. 11 sec. | 24 min. 56 sec. |
| 45 | 18 min. 39 sec. | 26 min. 27 sec. |

As stated before, according to the image forming apparatus of Embodiment 1, the feeding interval at the time of the following printing is set to the proper value in accordance with the printing hysteresis and the elapsed time from the previous printing, and therefore, the fixing and the heat deterioration of the pressing member can be prevented without lowering the print productivity significantly.

The Second Embodiment

Another example of the image forming apparatus will be described. In the description of the second Embodiment, the same reference numerals as in the first Embodiment are assigned to the member having the corresponding functions, and the description of such members are omitted for the sake of simplicity. The image forming apparatus shown in the second embodiment is constituted as follows. The initial feeding interval in the printing operation is determined on the basis of the final detected temperature of the second temperature-detecting member 15 in the previous print operation (last non-sheet-passing-range temperature), and, the elapsed time from the end of the previous print operation to the start of the current print operation. Also in the image forming apparatus of the second embodiment, the effect similar to the image forming apparatus of the first embodiment can be provided. FIG. 5 is a flowchart of the control sequence for the feeding interval executed by the controller C of the image forming apparatus relating to the second embodiment. In FIG. 5, since steps 1-2 is the same as steps 1-2 of FIG. 1, the description thereof is omitted.

Step 3: A non-sheet-passing-range temperature Tend in the process for the last paper in the previous print operation is obtained. The non-sheet-passing-range temperature Tend is a temperature detected by the second temperature-detecting member 15 described above. The non-sheet-passing-range temperature Tend is stored at the time of the end of the series of operation. This is step 10.

Step 4: The Table 4 is looked up, and the initial stage feeding interval in the current print operation is determined on the basis of the non-sheet-passing-range temperature in the process for the last paper in the previous print operation-Tend, and, the elapsed time t to the start of the current print operation from the end of the previous print operation.

TABLE 4

| Last Temp. of Non-passage area Tend (degree C.) | Elapsed time from Last printing (sec) | | | | |
|---|---|---|---|---|---|
| | t ≦ 10 | 10 < t ≦ 20 | 20 < t ≦ 40 | 40 < t ≦ 60 | 60 < t |
| 250 ≦ T | 15 | 10 | 6 | 4 | 3 |
| 240 ≦ T < 250 | 10 | 6 | 4 | 3 | 3 |
| 230 ≦ T < 240 | 6 | 4 | 3 | 3 | 3 |
| 210 ≦ T < 230 | 4 | 3 | 3 | 3 | 3 |
| T < 210 | 3 | 3 | 3 | 3 | 3 |

Since steps 5-9 are the same as steps 5-9 of FIG. 1, the description thereof is omitted. Step 11: non-sheet-passing-range temperature in the last paper process in the previous print operation Tend is stored. Since steps 12-13 is the same as steps 12 and 13 of FIG. 1, the description thereof is omitted. Using the determining method for the feeding interval of the image forming apparatus in the second embodiment, as a result of the experiment similar to Embodiment 1, the effects similar to Embodiment 1 are confirmed. More particularly, the print can be carried out with the feeding interval corresponding to the degree of the temperature rise of the non-sheet-passing-range, the heat deterioration by the temperature rise of the non-sheet-passing-range is prevented, and, the print productivity is not lowered significantly.

Other embodiments In the image forming apparatus of the first embodiment, in order to determine the initial feeding interval in the current print operation, the following structure may be employed. A recording material width detecting member for detecting the width of the recording material measured in the direction perpendicular to the sheet feeding direction is provided, and when the recording material width detected by the recording material width detecting member is below the maximum width of the recording material, the initial feeding interval in the current print operation is determined, as follows. The above described initial feeding interval is determined on the basis of the last feeding interval in the previous print operation, and the elapsed time from the end of the previous print operation to the start of this image forming operation. In the image forming apparatus of the second embodiment, in order to determine the initial feeding interval in the current print operation, the following structure may be employed. A recording material width detecting member for detecting the width of the recording material measured in the direction perpendicular to the sheet feeding direction is provided, and when the recording material width detected by the recording material width detecting member is below the maximum width of the recording material, the initial feeding interval in the current print operation is determined, as follows. The above-described initial feeding interval is determined on the basis of the detected temperature of the second temperature-detecting member the time of the last recording material passing the fixing device in the previous print operation, and, the elapsed time to the start of the current print operation from the end of the previous print operation.

While the invention has been described with reference to the structures disclosed herein, it is not confined to the details set forth, and this application is intended to cover such modification or changes as may come within the purposes of the improvements or the scope of the following claims.

This application claims priority from Japanese Patent Application No. 155663/2009 filed Jun. 30, 2009 which is hereby incorporated by reference.

What is claimed is:

1. An image forming apparatus comprising:

an image forming station configured to form a toner image on a recording material;

an image fixing station configured to heat fix the toner image formed on the recording material onto the recording material; and a feeding controller configured to control feeding of the recording material, wherein when a size of the recording material is smaller than a reference size, the feeding controller controls a feeding interval between a precedent recording material and a subsequent recording material in response to a temperature of the image fixing station in a non-sheet-passing-range, and wherein when image formation on a plurality of recording materials which are smaller than a reference size is started at a timing at which an elapsed time from an end of a last image formation exceeds a predetermined time, the feeding controller sets an initial feeding interval to a predetermined minimum feeding interval, and wherein when image formation on a plurality of recording materials smaller than the reference size is started at a timing at which the elapsed time is shorter than the predetermined time, the feeding controller selects the initial feeding interval from a plurality of feeding intervals in accordance with the elapsed time within a range longer than the predetermined minimum feeding interval and equal to or shorter than a last feeding interval at the time of an image formation of a last time, and sets the initial feeding interval.

2. The image forming apparatus according to claim 1, wherein the fixing station is provided with a fixing film, a heater contacted to said fixing film, and a pressing roller which forms a fixing nip in corporation with said heater through said fixing film.

3. The image forming apparatus according to claim 2, further comprising a temperature detecting member which detects the temperature of the heater in the non-sheet-passing-range, and the feeding controller controls the feeding interval between a precedent recording material and a subsequent recording material in response to the temperature detected by the detecting member.

4. The image forming apparatus according to claim 1, wherein the feeding controller selects the interval which decreases with an increase of the elapsed time.

5. The image forming apparatus according to claim 1, wherein the predetermined time is different depending on the last feeding interval at the time of an image formation of the last time.

6. An image forming apparatus comprising:

an image forming station configured to form a toner image on a recording material;

an image fixing station configured to heat fix the toner image formed on the recording material onto the recording material; and a feeding controller configured to control feeding of the recording material, wherein when a size of the recording material is smaller than a reference size, the feeding controller controls a feeding interval between a precedent recording material and a subsequent recording material in response to a temperature of the image fixing station in a non-sheet-passing-range, and wherein when image formation on a plurality of recording materials which are smaller than a reference size is started at a timing at which an elapsed time from an end of a last image formation exceeds a first predetermined time, the feeding controller sets an initial feeding interval to a predetermined minimum feeding interval, and wherein when image formation on a plurality of recording materials smaller than the reference size is started at timing at which the elapsed time is shorter than the first predetermined time and is longer than a second predetermined time shorter than the first predetermined time, the feeding controller sets the initial feeding interval, which is shorter than a last feeding interval at the time of an image formation of a last time and longer than the predetermined minimum feeding interval, in accordance with the elapsed time.

7. The image forming apparatus according to claim 6, wherein the fixing station is provided with a fixing film, a heater contacted to said fixing film, and a pressing roller which forms a fixing nip in corporation with said heater through said fixing film.

8. The image forming apparatus according to claim 6, wherein when image formation on a plurality of recording materials smaller than the reference size is started at a timing at which the elapsed time from the end of the last image formation is shorter than the second predetermined time, the feeding controller sets the initial feeding interval to the last feeding interval at the time of an image formation of the last time.

9. The image forming apparatus according to claim 7, further comprising a temperature detecting member which detects the temperature of the heater in the non-sheet-passing-range, and the feeding controller controls the feeding interval between a precedent recording material and a subsequent recording material in response to the temperature detected by the detecting member.

10. An image forming apparatus comprising:

an image forming station configured to form a toner image on a recording material;

an image fixing station configured to heat fix the toner image formed on the recording material onto the recording material; and a feeding controller configured to control feeding of the recording material, wherein when a size of the recording material is smaller than a reference size, the feeding controller controls a feeding interval between a precedent recording material and a subsequent recording material in response to a temperature of the image fixing station in a non-sheet-passing-range, and wherein when image formation on a plurality of recording materials which are smaller than a reference size is started at a timing at which an elapsed time from an end of a last image formation exceeds a predetermined time, the feeding controller sets an initial feeding interval to a predetermined minimum feeding interval, and wherein when image formation on a plurality of recording materials smaller than the reference size is started at a timing at which the elapsed time is shorter than the predetermined time, the feeding controller selects the initial feeding interval from a plurality of feeding intervals, and sets the initial feeding interval.

* * * * *